US008770578B2

(12) United States Patent
Yamamoto et al.

(10) Patent No.: US 8,770,578 B2
(45) Date of Patent: Jul. 8, 2014

(54) SHEET FEEDING APPARATUS AND IMAGE FORMING APPARATUS

(71) Applicant: Canon Kabushiki Kaisha, Tokyo (JP)

(72) Inventors: Shingo Yamamoto, Tokyo (JP); Fumihiko Hayayumi, Abiko (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 14/013,777

(22) Filed: Aug. 29, 2013

(65) Prior Publication Data

US 2014/0062012 A1 Mar. 6, 2014

(30) Foreign Application Priority Data

Sep. 4, 2012 (JP) ..... 2012-194201
Jul. 25, 2013 (JP) ..... 2013-154892

(51) Int. Cl.
*B65H 1/00* (2006.01)

(52) U.S. Cl.
USPC ..... 271/171; 399/393

(58) Field of Classification Search
USPC ..... 271/171; 399/393
See application file for complete search history.

(56) References Cited

U.S. PATENT DOCUMENTS 6,916,019 B2 * 7/2005 Takahashi ..... 271/145

FOREIGN PATENT DOCUMENTS

JP 2006-347662 A 12/2006

* cited by examiner

*Primary Examiner* — Michael McCullough
(74) *Attorney, Agent, or Firm* — Rossi, Kimms & McDowell, LLP

(57) ABSTRACT

A sheet feeding apparatus restricts a position of an upstream end of a sheet by a restricting member supported rotatably to a restricting mechanism body. The restricting member moves between a hold position and a project position by interlocking with a rotating operation of an sheet supporting plate by engaging with an interlock member. An unlock mechanism unlocks the restricting mechanism body from a cassette body and also disengages the restricting member from the interlock member. When the restricting member is disengaged from the interlock member by the unlock mechanism, the restricting member is biased to the hold position by a bias portion.

9 Claims, 7 Drawing Sheets

SHEET FEEDING APPARATUS AND IMAGE FORMING APPARATUS

BACKGROUND OF THE INVENTION

1. Field of the Invention

The present invention relates to a sheet feeding apparatus including a sheet cassette configured to stack a sheet, and to an image forming apparatus including the same.

2. Description of the Related Art

There is generally known a configuration for separating and feeding sheets stacked in a sheet cassette (sheet feeding cassette) one by one to an image forming portion in a sheet feeding apparatus provided in an image forming apparatus such as a printer, a copier or the like. Conventionally, as such configuration of the sheet feeding apparatus for separating and feeding sheets, Japanese Patent Application Laid-open No. 2006-347662 has disclosed a sheet cassette provided with a bottom plate that oscillates up and down with respect to a body of the sheet cassette. This arrangement makes it possible to feed sheets stacked in the sheet cassette while separating one by one by making an uppermost sheet among the sheets contact with and separate from a feed roller by oscillating the bottom plate.

The sheet feeding cassette described above is also provided with an end guide that guides a rear end of the sheets stacked therein. This end guide is configured such that a hook portion thereof is engaged with an engage member that slides on the sheet feeding cassette in linkage with the oscillation of the bottom plate so that the end guide can rotate back and forth concurrently with the oscillation of the bottom plate.

Still further, the end guide is formed such that a position thereof can be adjusted back and forth in accordance to a sheet size by disengaging the end guide from a fixing groove by lifting an end guide fixing member by an end guide manipulating portion. It is noted that Japanese Patent Application Laid-open No. 2006-347662 also describes that it is desirable to be able to unlock the hook portion described above from the engage member by manipulating the end guide manipulating portion at this time.

By the way, if the sheet feeding cassette is configured such that the hook portion is disengaged in linkage with the end guide fixing member as described above, an interlocking relationship between the end guide and the bottom plate is also released by disengaging the hook portion. If a user freely moves the end guide at this time, there is a possibility that a positional correlation of the end guide with the bottom plate is shifted.

SUMMARY OF THE INVENTION

According to an aspect of the present invention, a sheet feeding apparatus of the invention includes a sheet cassette storing a sheet and feeding the sheet from the sheet cassette. The sheet cassette includes a cassette body configured to store the sheet, a sheet supporting plate provided rotatably within the cassette body such that the sheet stored in the cassette body is stacked thereon and an upstream end restricting mechanism provided within the cassette body to restrict an upstream end position in a sheet feeding direction of the sheet stored in the cassette body. The upstream end restricting mechanism includes a restricting mechanism body, a restricting member supported rotatably by the restricting mechanism body and abutting against an upstream end of the sheet to restrict the upstream end position of the sheet, an interlock member configured to engage with the restricting member and to move the restricting member by interlocking with a rotating operation of the sheet supporting plate between a hold position where the restricting member is held to the restricting mechanism body side and a project position where the restricting member projects to the sheet supporting plate side, a fixing member configured to fix the restricting mechanism body to the cassette body, an unlock mechanism configured to unlock the fixing member from the cassette body and to disengage the restricting member from the interlock member in linkage with the unlock of the fixing member from the cassette body to permit a position of the restricting mechanism body to be adjusted in the sheet-feeding direction and a bias portion that biases the restricting member disengaged from the interlock member by the unlock mechanism to the hold position.

Further features of the present invention will become apparent from the following description of exemplary embodiments with reference to the attached drawings.

DESCRIPTION OF THE EMBODIMENTS

<Overall Configuration of Image Forming Apparatus>

A sheet feeding apparatus and an image forming apparatus including the sheet feeding apparatus of an embodiment of the invention will be described below with reference to the drawings. An overall configuration of the image forming apparatus will be described first.

Figure 1:
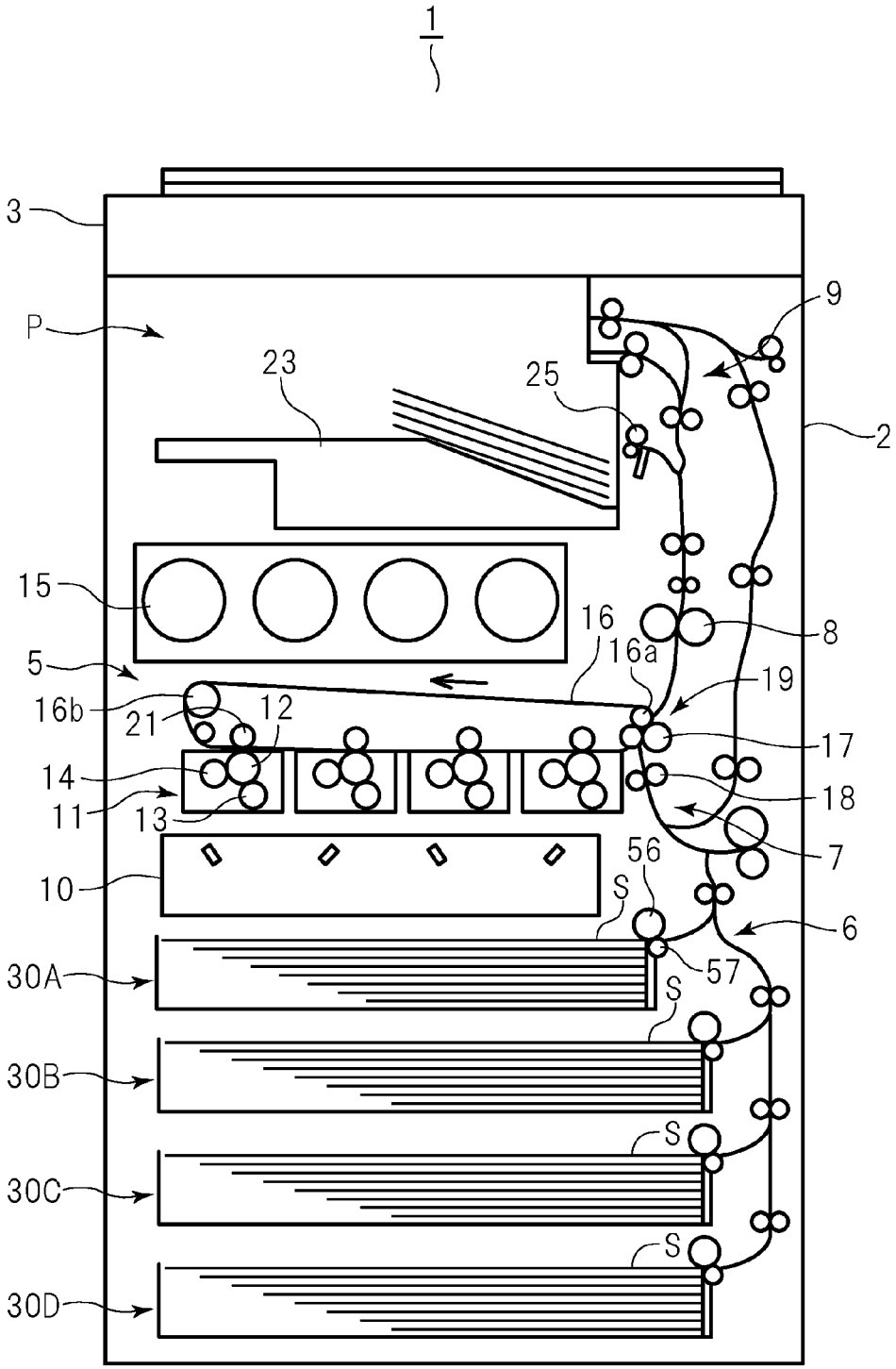
FIG. 1 is a schematic diagram illustrating a configuration of a full-color laser beam printer, i.e., an exemplary image forming apparatus, of an embodiment of the invention.

As shown in FIG. 1, the full-color laser beam printer (referred to simply as a 'printer' hereinafter) 1 as the image forming apparatus includes a printer body 2 that is a main body of the image forming apparatus, and an image reading unit 3 provided above the printer body 2. Included within the printer body 2 are an image forming portion 5 configured to form an image on a sheet, a sheet feeding apparatus 6 configured to separate and feed the sheet one by one to the image forming portion 5, and a sheet conveying portion 7 configured to convey the sheet fed from the sheet feeding apparatus 6 to the image forming portion 5. The printer body 2 also includes a fixing portion 8 configured to fix a toner image formed by the image forming portion 5 to the sheet, and a discharge portion 9 configured to discharge the sheet on which the toner image has been fixed out of the printer body 2.

More specifically, image information read by the image reader 3 or image information transmitted from an external equipment such as a personal computer not shown is input, the printer 1 performs image processing on the information, and converts into electrical signals to transmit to a laser scanner 10 of the image forming portion 5. Then, the laser scanner 10 scans a surface of each photoconductive drum 12 in each processing cartridge 11 by irradiating one of laser lights corresponding to image information of component colors of yellow, magenta, cyan and black in the image forming portion 5. With this arrangement, the surface of the photoconductive drum 12 which is charged homogeneously with predetermined polarity and potential by a charger 13 is sequentially exposed, and electrostatic latent images of yellow, magenta, cyan and black are formed sequentially and respectively on the photoconductive drums 12 of the processing cartridges 11.

After that, the electrostatic latent images are developed and visualized by using the respective color toners of yellow, magenta, cyan and black stored in toner cartridges 15. Then, the respective color toner images on the respective photoconductive drums are superimposed and transferred sequentially on an intermediate transfer belt 16 by a primary transfer bias applied to a primary transfer roller 21. Thus, the toner images are formed on the intermediate transfer belt 16.

Meanwhile, a sheet S on which the toner image is to foe formed is fed from the sheet feeding apparatus 6 concurrently with the formation of the toner image. Specifically, the sheet feeding apparatus 6 is provided with at least, one sheet cassette (four sheet cassettes 30A through 30D in the present embodiment) that is configured to stack sheets on which images are to be formed by the image forming portion 5. The sheet feeding apparatus 6 is also provided with feed rollers (sheet feeding members) 56 for feeding the sheets from the respective sheet cassettes 30A through 30D, separation members 57 disposed so as to face the respective feed rollers 56, and others. With this arrangement, the sheet feeding apparatus 6 feeds each sheet by the feed roller 56 from the sheet cassette in which the sheet of a size designated from a control portion not shown is stored on a predetermined timing concurrently with the operation of the image forming portion 5 forming the toner image.

The sheet S fed out of one of the sheet cassettes 30A through 30D of the sheet feeding apparatus 6 is conveyed to a secondary transfer portion 19 of the image forming portion 5 by a registration roller pair 18 composing the abovementioned sheet conveying portion 7. The secondary transfer portion 19 is composed of a drive roller 16*a* and a secondary transfer roller 17, and a transfer bias voltage is applied to the secondary transfer roller 17 to transfer all of the toner images on the intermediate transfer belt 16 to the sheet S.

The sheet S on which the toner images have been transferred is then conveyed to the fixing portion 8 to fix the toner images on the sheet S by applying heat and pressure. Then, the sheet S is discharged to a discharge space P between the image reader 3 and the printer body 2 by a first sheet discharge roller pair 25 that composes the discharge portion 9. The process of printing the image on the sheet is completed by stacking the sheet on a stacking portion 23 located at a bottom of the discharge space P.

<Configuration of Sheet Cassette>

Next, a configuration of the sheet cassettes 30A through 30D will foe explained in detail with reference to FIGS. 2 and 3. It is noted that because configurations of the four sheet cassettes 30A through 30D described above are basically the same, the configuration of the sheet cassette will be described by using the sheet cassette 30A and an explanation of the other sheet cassettes will be omitted in the following explanation.

Figure 2:
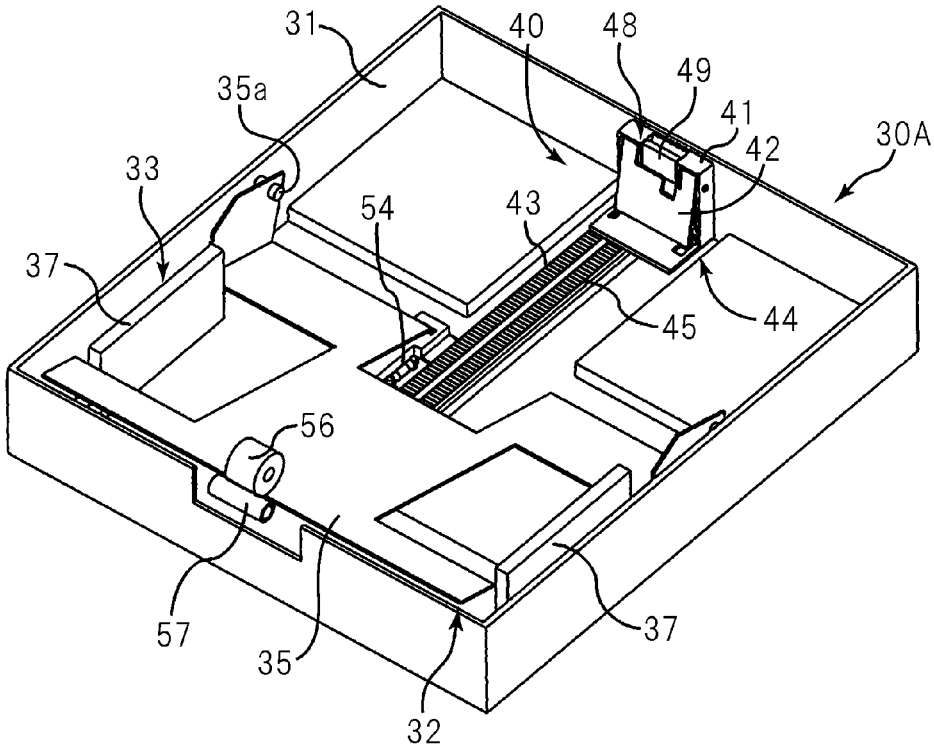
FIG. 2 is a perspective view showing a sheet feeding apparatus provided in the full-color laser beams printer.
Figure 3:
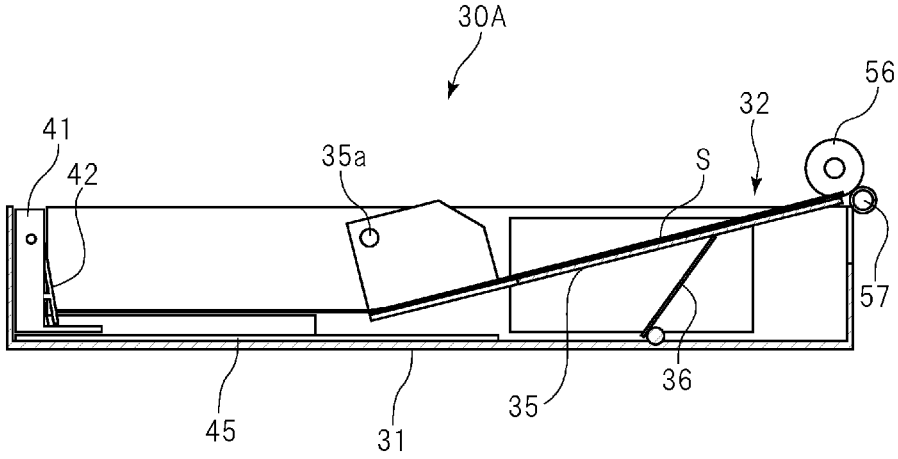
FIG. 3 is a section view of the sheet feeding apparatus.

As shown in FIGS. 2 and 3, the sheet cassette 30A is formed into a shape of a box, and includes a cassette body 31 that stores the sheets, and a lift mechanism 32 configured to lift a downstream side in a sheet feeding direction of the sheets (front end of the sheets) stored in the cassette body 31 to make an uppermost sheet of the sheets contact with the feed roller 56. The sheet cassette 30A also includes a side restricting mechanism 33 configured to restrict a widthwise position of the stored sheets, and an upstream end restricting mechanism 40 configured to restrict an upstream end position (rear end of the sheet) in the sheet feeding direction of the sheets stored in the cassette body 31.

The lift mechanism 32 includes a sheet supporting plate 35 provided rotatably within the cassette body 31 to support the stacked sheets and a lifter arm 36, and configured such that the sheet supporting plate 35 rotates (turns) up and down centering on a fulcrum 35*a* in response to a rotation of the lifter arm 36 (see FIG. 3). The sheet supporting plate 35 is located at a bottom of the cassette body 31, so that the sheets to be stored in the cassette body 31 are stacked on the sheet supporting plate 35. Thereby, the downstream portion in the conveying direction of the sheet moves up and down by the sheet supporting plate 35 that moves up and down.

More specifically, the lifter arm 36 is configured to drive the sheet supporting plate 35 by a drive gear not shown provided on a side of the printer body 2 and in mesh with a sector gear not shown attached to the lifter arm 36. Therefore, the sheet supporting plate 35 returns to the lower position where the sheet supporting plate 35 is lowered to the cassette body side when the sheet cassette 30A is drawn out of the printer body 2 because the gears are unmeshed and due to own weight of the sheet supporting plate 35 and to a bias force of a return spring 54 described later.

It is noted that the sheet feeding apparatus 6 has a sheet surface detecting sensor not shown that detects an upper surface position of the sheet stacked in the sheet cassette 30A, and an uplift position of the sheet supporting plate 35 is set at a predetermined sheet-feedable position based on the detected result of the sheet surface detecting sensor. That is, the uplift position is set at a rotating position where the feed roller 56 disposed so as to face the upper part of the sheet cassette as the sheet feeding apparatus 6 can feed the sheet by pressing the uppermost sheet of the sheets stored in the sheet cassette 30A.

The side restricting mechanism 33 includes a pair of side restricting plates 37 provided to be movable in a width direction orthogonal to the sheet feeding direction. The pair of side restricting plates 37 restricts a widthwise move of the sheet and determines widthwise positions thereof.

<Configuration of Upstream End Restricting Mechanism>

Next, the configuration of the upstream end restricting mechanism 40 described above will be explained in detail with reference to FIGS. 2 and 3. As shown in FIG. 2, the upstream end restricting mechanism 40 includes a restricting mechanism body 41, and a restricting member 42 supported rotatably to the restricting mechanism body 41. A rear end restricting member 44 is composed of the restricting mechanism body 41 and the restricting member 42, and the restricting member 42 positions the sheet in the sheet feeding direction by abutting against an upstream end of the sheet (rear end of the sheet).

The upstream end restricting mechanism 40 also includes an interlock member 43 that engages with and moves the restricting member 42 between a hold position where the restricting member 42 is held in the restricting mechanism body 41 and a project position where the restricting member 42 projects toward the sheet supporting plate 35 in linkage with the rotating operation of the sheet supporting plate 35. Specifically, the interlock member 43 is provided on the bottom surface of the cassette body 31 as a rack member capable of moving in the sheet feeding direction, and one end thereof is connected with a rotating end of the sheet supporting plate 35. Therefore, the interlock member 43 moves downstream in the sheet feeding direction when the sheet supporting plate 35 rises, and moves upstream in the sheet feeding direction when the sheet supporting plate 35 drops. The upstream end restricting mechanism 40 is also provided with the return spring (third biasing member) 54 that biases the interlock member 43 connected to the sheet supporting plate 35 upstream in the sheet feeding direction such that a same displacement can be obtained every time when the sheet supporting plate 35 oscillates.

Thus, the interlock member 43 moves in the sheet feeding direction in linkage with the sheet supporting plate 35, so that the restricting member 42 is rotated to a position linked with the rotation of the sheet supporting plate 35. That is, when the sheet supporting plate 35 is located at the uplift position, the restricting member 42 is located at the project position, and when the sheet supporting plate 35 is located at the lower position, the restricting member 42 is located at the hold position. It is noted that the uplift position of the sheet supporting plate 35 varies in accordance to an amount of the stacked sheets as described above, the project position of the restricting member 42 also varies corresponding to the uplift position of the sheet supporting plate 35.

Accordingly, even if the sheet supporting plate 35 rises and the upstream end of a sheet bundle stored in the sheet cassette 30 inclines aslant, the upstream end restricting mechanism 40 can align the upstream end of the sheet bundle by rotating the restricting member 42 in accordance to the inclination of the upstream end of the sheet bundle. When the sheet supporting plate 35 drops, the restricting member 42 recedes upstream in the sheet feeding direction, so that it is possible to prevent the sheets from being deflected by being pushed by the restricting member 42.

By the way, the upstream end restricting mechanism 40 is also configured such that the restricting mechanism body 41 is movable in the sheet feeding direction in accordance to a size of a sheet to be fed similarly to the side restricting mechanism 33. Specifically, the upstream end restricting mechanism 40 is provided with the rack portion 45 fixed on the bottom surface of the cassette body 31 and extending in the sheet feeding direction, and a fixing member 46 that engages with the rack portion 45 to fix the restricting mechanism body 41 to the cassette body 31.

The restricting mechanism body 41 is also provided with an unlock lever 49 that composes an unlock mechanism 48 configured to unlock the fixing member (first stopper) 46 from the cassette body 31. When the unlock lever 49 is rotated in a direction of an arrow in FIG. 5B, the fixing member 46 is unlocked and in linkage with the unlock operation, the restricting member 42 is also disengaged from the interlock member 43, enabling to adjust the position in the sheet feeding direction of the restricting mechanism body 41.

<Configuration Around Unlock Mechanism>

Figure 4A:
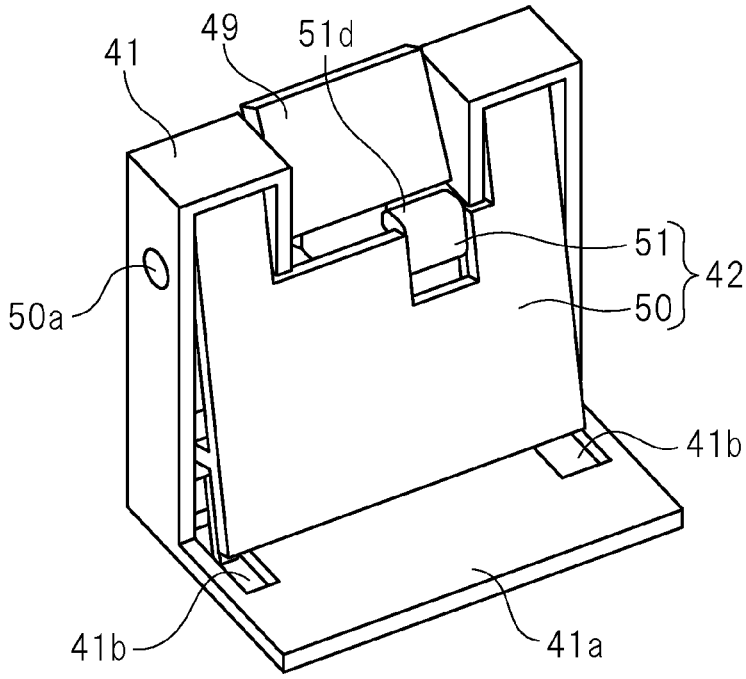
FIG. 4A illustrates a configuration of a rear end restricting member provided in the sheet feeding apparatus.
Figure 4B:
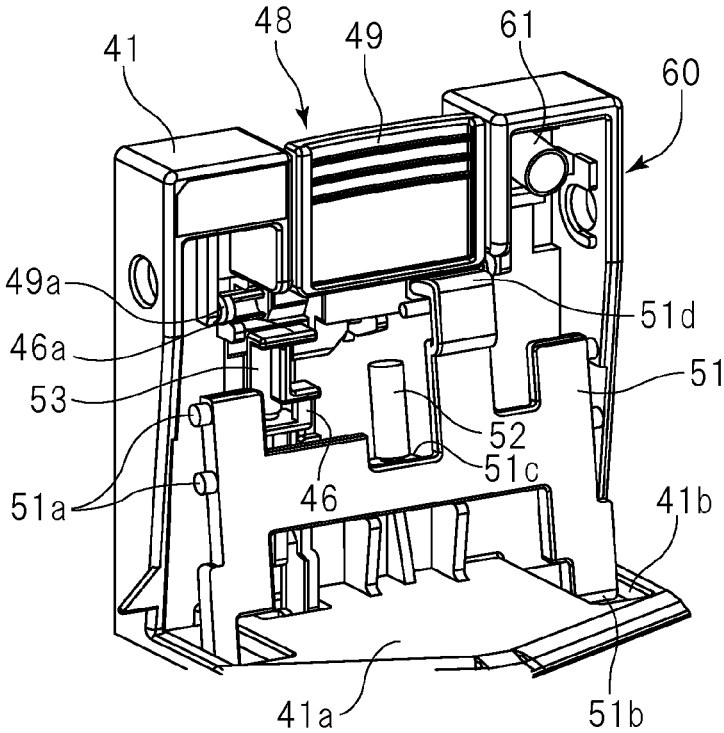
FIG. 4B illustrates the rear end restricting member in a condition in which a restricting plate is removed.
Figure 5A:
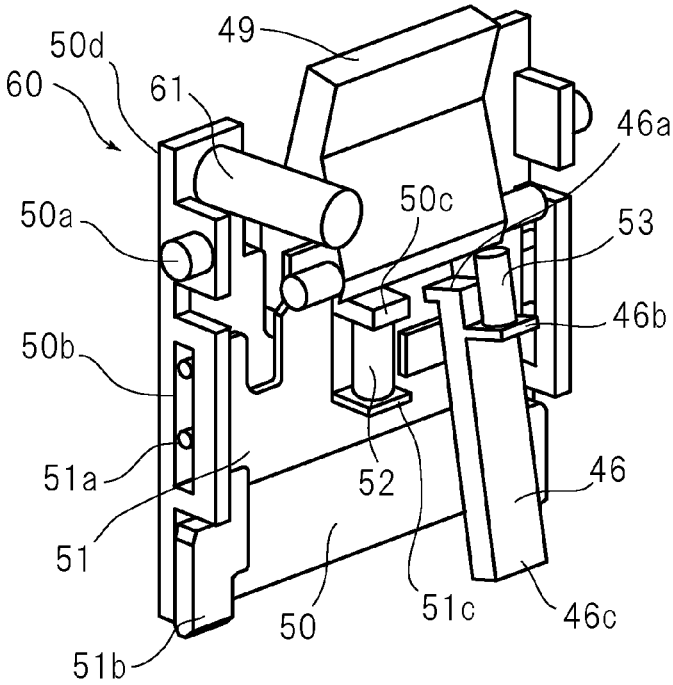
FIG. 5A illustrates the rear end restricting member, seen from a backside thereof, in a condition in which a restricting mechanism body is removed.
Figure 5B:
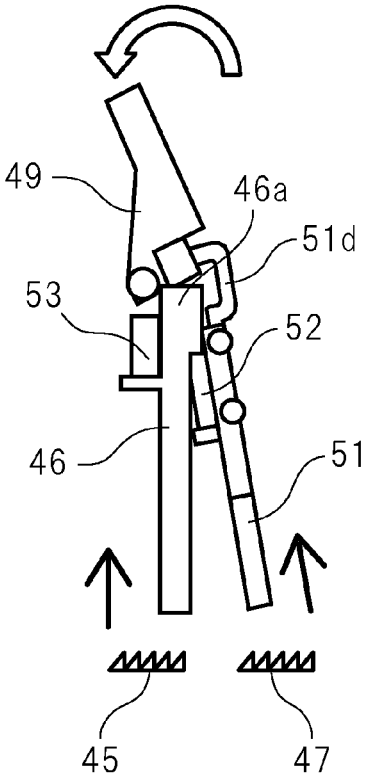
FIG. 5B is a schematic diagram illustrating an operation in unlocking the rear end restricting member.

Next, a configuration around the unlock mechanism 48 will be explained with reference to FIGS. 4 and 5. As shown in FIGS. 4A through 5B, the restricting member 42 includes a restricting plate 50 rotatably attached to an upper part of the restricting mechanism body 41 centering en the rotating shaft 50*a*, and an engage member (second stopper) 51 engaged with the interlock member 43. The restricting plate 50 is a part that actually abuts against the upstream end of the sheet, and the engage member 51 is attached to a back surface of the restricting plate 50 by projections 51*a* provided on sides of the engage member 51 and fitted into slot-like fitting portions 50*b* of the restricting plate 50.

The engage member 51 is provided with a tooth portion 51*b* at a lower end thereof and configured to engage with the rack-like interlock member 43. The tooth portion 51*b* is configured to project out of a groove 41*b* provided through a bottom portion 41*a* of the restricting mechanism body 41.

The engage member 51 also includes a pedestal portion 51*c* projecting toward the restricting mechanism body 41, and the restricting plate 50 includes a pedestal portion 50*c* formed above the pedestal portion 51*c* so as to face the pedestal portion 51*c* in a condition in which the engage member 51 is assembled with the restricting plate 50. A spring 52 is provided contractively between the pedestal portions 50*c* and 51*c* of the restricting plate 50 and the engage member 51, and the engage member 51 is always biased downward toy a bias force of the spring 52.

That is, the engage member 51 is configured to be movable up and down within the slot-like fitting portion 50*b* along the restricting plate 50, and is kept at an engage position where the engage member 51 is engaged with the interlock member 43 by being biased downward by the spring 52. Then, the restricting mechanism body 41 is to be moved in the sheet feeding direction, the engage member 51 is lifted up going against the bias force of the spring 52 by rotating the unlock lever 49 through an intermediary of an engagement portion 51*d* engaging with the unlock lever 49.

Meanwhile, the fixing member 46 also engages with the unlock lever 49 at an engage portion 46*a*, and is also provided with a spring 53 on a pedestal portion 46*b* projecting toward the restricting mechanism body 41 side. Because another end of the spring 53 is supported by the restricting mechanism body 41, the fixing member 46 is also biased downward by a bias force of the spring 53, and a tooth portion 46*c* projects downward through a hole 41*c* of the restricting mechanism body 41 and engages with the rack portion 45.

Thus, the engage member 51 and the fixing member 46 engage respectively with the unlock lever 49 at the engage portions 51*d* and 46*a*, so that when the unlock lever 49 is rotated as shown in FIG. 5B, the engage member 51 and the fixing member 46 move upward and are disengaged from the interlock member 43 and the rack portion 45.

By the way, there is a possibility that the positional interlocking relationship between the restricting member 42 and the sheet supporting plate 35 collapses if the restricting member 42 is freely rotated in the condition in which the engage portion 46*a* is disengaged from the interlock member 43. Specifically, the sheet cassette 30 of the present embodiment is configured such that the sheet supporting plate 35 drops to the lower position when the sheet cassette 30 is drawn out of the printer body 2 as described above. Therefore, the sheet supporting plate 35 must be located at the lower position and the restricting member 42 must be located at the hold position corresponding to the lower position in moving the restricting mechanism body 41.

Then, the upstream end restricting mechanism 40 is provided with a bias portion 60 that biases the restricting member 42 disengaged from the interlock member 43 by the unlock mechanism 48 to a predetermined position (the hold position in the present embodiment) corresponding to the rotating position of the sheet supporting plate 35.

<Configuration of Biasing Portion>

Next, a configuration of the bias portion 60 will be explained in detail with reference to FIGS. 4 through 7. The bias portion 60 includes a first bias portion that rotates the restricting member 42 by using a bias force of a first spring 61, i.e., a first bias member, and a second bias portion that rotates the restricting member 42 by using a bias force of the spring (referred to as a second spring hereinafter) 52, i.e., a second bias member.

Figure 6:
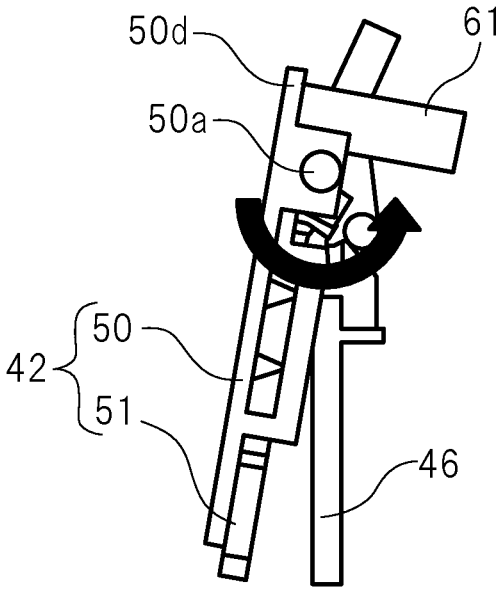
FIG. 6 is a schematic diagram illustrating an operation of a first bias portion.

The first spring 61 is disposed between the restricting mechanism body 41 and the restricting member 42 such that its bias direction orients in the sheet feeding direction, and generates the bias force that rotates the restricting member 42 to the hold position when the restricting member 42 is disengaged from the interlock member 43. More specifically, as shown in FIGS. 4B and 5A, the first spring (return resilient member) 61 is contracted between an ear portion 50*d* of the restricting plate 50 and the restricting mechanism body 41 at part, above the rotating shaft 50*a* of the restricting plate 50. Therefore, when the unlock lever 49 is rotated to unlock the engage member 51 from the interlock member 43, the ear portion 50*d* is biased upstream in the sheet feeding direction by the bias force of the first spring 61 as shown in FIG. 6, and the restricting member 42. rotates toward the hold position. The first bias portion is thus composed of the first spring 61, the ear portion 50*d* and the restricting mechanism body 41.

It is noted that the first spring 61 may be disposed on a side lower than the rotating shaft 50*a* as long as it is disposed between the restricting member 42 (or preferably the restricting plate 50) and the restricting mechanism body 41. In this case, the bias force of the first spring 61 is set in a direction of pulling the engage member 51 disengaged from the interlock member 43 downstream in the sheet feeding direction.

The second spring 52 of the second bias portion is a bias member that generates a bias force biasing the engage member 51 downward to keep the condition engaged with the interlock member 43 as described above. One end of the second spring 52 is supported by the restricting mechanism body 41 through the pedestal portion 50*c* of the restricting plate 50 and the rotating shaft 50*a*, so that the bias force acts downward to the engage member 51 to which another end is attached as indicated by an arrow 70 in FIG. 7A.

Here, the unlock lever 49 is supported rotatably by the restricting mechanism body 41 by another rotating shaft 49*a* different from the rotating shaft 50*a* of the restricting member 42. The engage portion 51*d* engaging with the unlock lever 49 of the engage member 51 described above engages with the unlock lever 49 such that the engage portion 51*d* fits into a recess 49*b* of the unlock lever 49 from downstream to upstream in the sheet feeding direction. The engage portion 51*d* also engages with the unlock lever 49 upstream in the sheet feeding direction of the restricting plate 50 more than the rotational center (center of turn) 100 of the rotating shaft 50*a* of the restricting plate 50 in the sheet feeding direction. That is, a contact point 101 of the engage portion 51*d* of the engage member 51 engaging with the unlock lever 49 and the recess 49*b* of the unlock lever 49 is always located upstream in the sheet feeding direction (the restricting mechanism body side) more than the rotational center 100, regardless of the oscillation of the engage member 51.

Figure 7A:
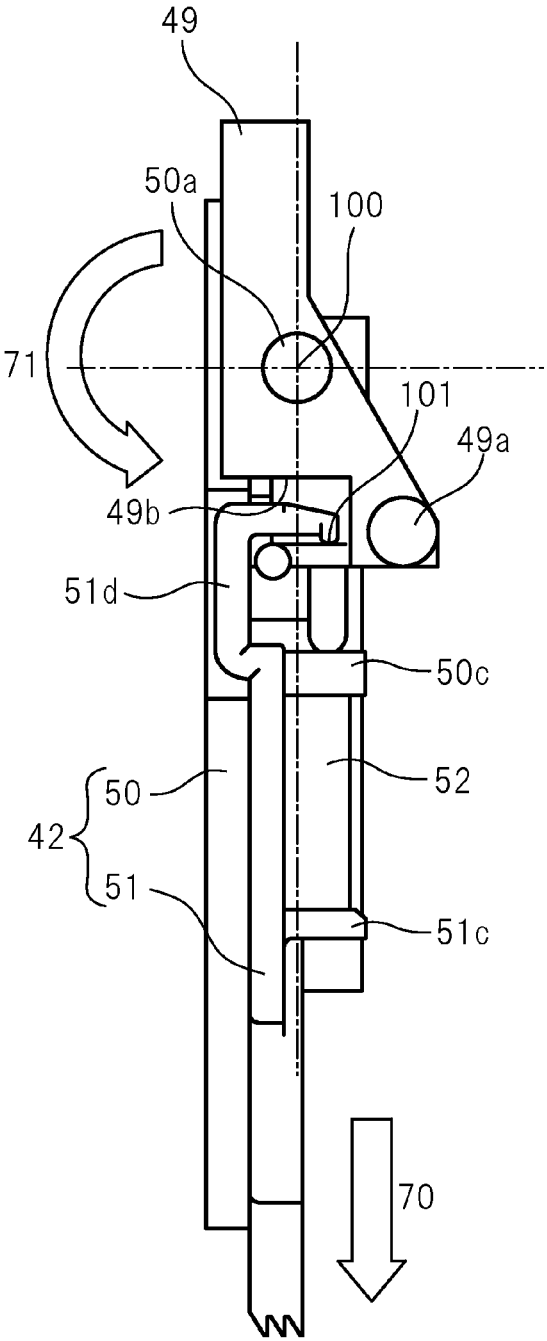
FIG. 7A is a schematic diagram illustrating an operation of a second bias portion.
Figure 7B:
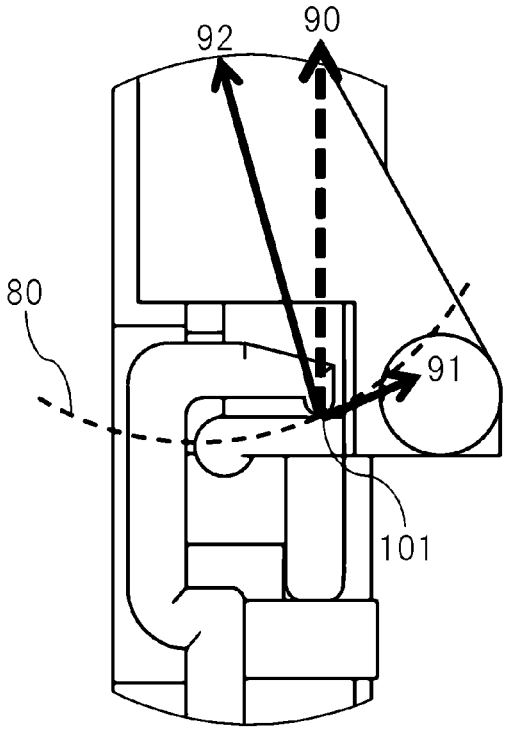
FIG. 7B is an enlarged view of a contact portion of an engage member and an unlock lever.

The bias force indicated by the arrow 70 and generated by the second spring 52 described above acts also on the engage member 51 in the condition disengaged from the interlock member 43 and elevated by the rotation of the unlock lever 49. Due to that, a reaction force as indicated by an arrow 90 and generated from the unlock lever 49 acts on the restricting member 42 (the engage member 51) at the contact point 101 as shown in FIG. 7B in the condition disengaged from the interlock member 43. This reaction force 90 acts on the contact point 101 located upstream in the sheet feeding direction more than the rotational center 100 of the restricting member 42, so that a rotating force (force of moment) rotating the restricting member 42 in a direction of an arrow 71 in FIG. 7A is generated.

That is, the reaction force 90 may be decomposed in terms of a rotating direction 80 of the engage member 51 as component forces 91 and 92, and the force 91 acts in the direction of holding the engage member 51, i.e., the restricting member 42, so that, the restricting member 42 returns to the hold position (initial position) when the engage member 51 is disengaged from the interlock member 43. Thus, the second bias portion is composed of the second spring 52 and the engage portion 51*d* of the engage member 51.

As described above, the bias portion 60 of the upstream end restricting mechanism 40 enables to keep the restricting member 42 disengaged from the interlock member 43 to the hold position corresponding to the sheet supporting plate 35 located at the lower position in adjusting the position of the restricting mechanism body 41. That is, the upstream end restricting mechanism 40 is configured such that the restricting member 42 is biased to the hold position by the first spring 61 of the first bias portion. Still further, the downward bias force of the second spring 52, i.e., the second bias portion, is converted into the force that rotates the restricting member 42 to the hold position by setting the contact point 101 of the engage member 51 with the unlock lever 49 upstream in the sheet feeding direction more than the rotational center 100. This arrangement makes it possible to keep the restricting member 42 at the position corresponding to the position of the sheet supporting plate 35 in changing the position of the restricting mechanism body 41 in accordance to a size of the sheet S and to prevent the positional correlation of the sheet supporting plate 35 and the restricting member 42 from shifting in moving the restricting mechanism body 41.

Still further, because this arrangement adequately keeps the positional correlation between the sheet supporting plate 35 and the restricting member 42, it is possible to securely position a sheet rear end corresponding to the rotation of the sheet supporting plate 35 by the restricting member 42 and to prevent the sheet otherwise from being interiorly fed. Furthermore, this arrangement makes it possible to obtain an adequate quantity of motion of the restricting member 42 with respect to the sheet supporting plate 35 and, to prevent a new sheet from being stacked in the sheet cassette 30 at a position where the interlock between the sheet supporting plate 35 and the restricting member 42 is shifted, and to prevent the sheet from being erroneously set. Thus, the sheet cassettes 30A through 30D can adequately restrict positions of the sheets by using the bias portion 60.

The bias portion 60 can also keep the positional correlation of the sheet supporting plate 35 and the restricting member 42 by the simple structure using the first and second springs 61 and 52. Still further, the bias force of the second spring 52 is used to keep the engagement of the restricting member 42 with the interlock member 43 and is also used as the rotating force of the restricting member 42 in adjusting the position of the restricting mechanism body 41. Therefore, it is possible to reduce a number of parts and to simplify the structure of the upstream end restricting mechanism 40.

Still further, the interlock member 43 is configured to move downstream in the sheet feeding direction in response to the upward rotation of the sheet supporting plate 35 and to move upstream in the sheet feeding direction in response to the downward rotation of the sheet supporting plate 35, and is biased upstream in the sheet feeding direction by the return spring 54. Thus, this arrangement makes it possible to reduce backlash of the interlock member 43, to obtain the adequate quantity of motion of the restricting member 42 with respect to the sheet supporting plate 35 and, and to keep the sheet supporting plate 35 at the lower position in adjusting the position of the restricting mechanism body 41.

It is noted that although the first through third bias members are constructed respectively by the first, second and return springs in the explanation described above, it is also possible to use an elastic member such as rubber, beside the springs. Still further, the mechanism for lifting the sheet supporting plate may be what lifts the plate by driving a spring and a cars for example, and may be configured in any manner as long as the sheet supporting plate is located at the lower position in drawing the sheet cassette. Still further, the bias portion 60 may be what is provided with either one of the first and second bias portions of the bias portion 60.

While the present invention has been described with reference to the exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-194201, filed on Sep. 4, 2012 and 2013-154892, filed on Jul. 25, 2013 which are hereby incorporated by reference herein in their entirety.

What is claimed is:

1. A sheet feeding apparatus comprising a sheet cassette storing a sheet and feeding the sheet from the sheet cassette, the sheet cassette comprising:

a cassette body configured to store the sheet;

a sheet supporting plate provided rotatably within the cassette body such that the sheet stored in the cassette body is stacked thereon; and an upstream end restricting mechanism provided within the cassette body to restrict an upstream end position in a sheet feeding direction of the sheet stored in the cassette body, the upstream end restricting mechanism comprising:

a restricting mechanism body;

a restricting member supported rotatably by the restricting mechanism body and abutting against an upstream end of the sheet to restrict the upstream end position of the sheet;

an interlock member configured to engage with the restricting member and to move the restricting member by interlocking with a rotating operation of the sheet supporting plate between a hold position where the restricting member is held to the restricting mechanism body side and a project position where the restricting member projects to the sheet supporting plate side;

a fixing member configured to fix the restricting mechanism body to the cassette body;

an unlock mechanism configured to unlock the fixing member from the cassette body and to disengage the restricting member from the interlock member in linkage with the unlock of the fixing member from the cassette body to permit a position of the restricting mechanism body to be adjusted in the sheet feeding direction; and a bias portion that biases the restricting member disengaged from the interlock member by the unlock mechanism to the hold position.

2. The sheet feeding apparatus according to claim 1, wherein the bias portion includes a bias member disposed between the restricting mechanism body and the restricting member such that a bias direction thereof orients in the sheet feeding direction, and generates a bias force such that the restricting member rotates to the hold position in the restricting member being disengaged from the interlock member.

3. The sheet feeding apparatus according to claim 2, wherein the restricting member includes a restricting plate attached to the restricting mechanism body rotatably centering on a rotating shaft, and an engage member attached to the restricting plate movably up and down along the restricting plate and engaging with the interlock member;

the unlock mechanism includes an unlock lever rotatably attached to the restricting mechanism body, engaging respectively with the engage portion and the fixing member, and unlocking the fixing member and disengaging the restricting member from the interlock member by rotating; and the bias portion includes a bias member that generates a bias force biasing the engage member downward, and an engage portion engaging with the unlock lever of the engage member engaging with the unlock lever upstream in the sheet feeding direction more than a rotational center of the rotating shaft of the restricting plate.

4. The sheet feeding apparatus according to claim 3, wherein the interlock member is configured to move downstream in the sheet feeding direction in response to the upward rotation of the sheet supporting plate and to move upstream in the sheet feeding direction in response to the downward rotation of the sheet supporting plate on a bottom surface of the cassette body; and wherein the upstream end restricting mechanism includes a bias member that biases the interlock member upstream in the sheet feeding direction.

5. The sheet feeding apparatus according to claim 2, wherein the interlock member is configured to move downstream in the sheet feeding direction in response to the upward rotation of the sheet supporting plate and to move upstream in the sheet feeding direction in response to the downward rotation of the sheet supporting plate on a bottom surface of the cassette body; and wherein the upstream end restricting mechanism includes a bias member that biases the interlock member upstream in the sheet feeding direction.

6. The sheet feeding apparatus according to claim 2, wherein the interlock member is configured to move downstream in the sheet feeding direction in response to the upward rotation of the sheet supporting plate and to move upstream in the sheet feeding direction in response to the downward rotation of the sheet supporting plate on a bottom surface of the cassette body; and wherein the upstream end restricting mechanism includes a bias member that biases the inter loch member upstream in the sheet feeding direction.

7. The sheet feeding apparatus according to claim 1, wherein the restricting member includes a restricting plate attached to the restricting mechanism body rotatably centering on a rotating shaft, and an engage member attached to the restricting plate movably up and down along the restricting plate and engaging with the interlock member;

the unlock mechanism includes an unlock lever rotatably attached to the restricting mechanism body, engaging respectively with the engage member and the fixing member, and unlocking the fixing member and disengaging the restricting member from the interlock member by rotating; and the bias portion includes a bias member that generates a bias force biasing the engage member downward, and an engage portion engaging with the unlock lever of the engage member engaging with the unlock lever upstream in the sheet feeding direction more than a center of the rotating shaft of the restricting plate.

8. The sheet feeding apparatus according to claim 7, wherein the interlock member is configured to move downstream in the sheet feeding direction in response to the upward rotation of the sheet supporting plate and to move upstream in the sheet feeding direction in response to the downward rotation of the sheet supporting plate on a bottom surface of the cassette body; and wherein the upstream end restricting mechanism includes a bias member that biases the interlock member upstream in the sheet feeding direction.

9. An image forming apparatus, comprising:

an image forming apparatus body;

an image forming portion provided within the image forming apparatus body and forming an image on a sheet; and the sheet feeding apparatus as set forth in claim 1 comprising the sheet cassette formed to be able to be drawn in and out of the image forming apparatus body;

wherein the sheet cassette is configured such that the sheet supporting plate is located at a lower position in a condition in which the sheet feeding apparatus is drawn out of the image forming apparatus body.

* * * * *